US012037763B1

(12) United States Patent
Zhang et al.

(10) Patent No.: US 12,037,763 B1
(45) Date of Patent: Jul. 16, 2024

(54) AUGER-SUCTION TYPE METRO JET SYSTEM (MJS) DEVICE FOR AERATED AND LIGHTWEIGHT CEMENT SOIL AND CONSTRUCTION METHOD THEREOF

(71) Applicant: HANGZHOU CITY UNIVERSITY, Hangzhou (CN)

(72) Inventors: Lisha Zhang, Hangzhou (CN); Xiao Wei, Hangzhou (CN); Zhongxuan Yang, Hangzhou (CN); Yunliang Cui, Hangzhou (CN); Xinquan Wang, Hangzhou (CN); Fushen Liu, Hangzhou (CN); Chaofa Zhao, Hangzhou (CN)

(73) Assignee: HANGZHOU CITY UNIVERSITY, Hangzhou (CN)

( * ) Notice: Subject to any disclaimer, the term of this patent is extended or adjusted under 35 U.S.C. 154(b) by 0 days.

(21) Appl. No.: 18/399,699

(22) Filed: Dec. 29, 2023

Related U.S. Application Data

(63) Continuation of application No. PCT/CN2023/121179, filed on Sep. 25, 2023.

(51) Int. Cl.
*E02D 5/46* (2006.01)
*E02D 15/04* (2006.01)
(Continued)

(52) U.S. Cl.
CPC ..... *E02D 5/46* (2013.01); *E02D 15/04* (2013.01); *E21B 7/003* (2013.01); *E21B 10/26* (2013.01);
(Continued)

(58) Field of Classification Search
CPC ..... E02D 5/46; E02D 15/04; E02D 7/003; E02D 10/26; E02D 17/18;
(Continued)

(56) References Cited

U.S. PATENT DOCUMENTS 4,496,011 A * 1/1985 Mazo ..... E21B 10/44 175/388
5,401,121 A * 3/1995 Nakashima ..... E02D 3/12 405/269
(Continued)

FOREIGN PATENT DOCUMENTS

CN 104563099 A 4/2015
CN 112575813 A 3/2021
(Continued)

OTHER PUBLICATIONS

CJJ/T177-2012, Technical Specification For Foamed Mixture Lightweight Soil Filling Engineering, Industry Standards of the People's Republic of China, 2012, pp. 1-38, 1-26, Ministry of Housing and Urban-Rural Development of the People's Republic of China.

*Primary Examiner* — Kyle Armstrong
(74) *Attorney, Agent, or Firm* — Bayramoglu Law Offices LLC

(57) ABSTRACT

An auger-suction type metro jet system (MJS) device for aerated and lightweight cement soil includes a multi-pipe device, an outer sleeve, an integrated device, a spiral conveyor, a reamer head, a pressure monitoring system, a mass measuring device, and a control console. The multi-pipe device integrates a backup pipe, a negative-pressure gas pipe, a hydraulic pipe, a negative-pressure water pipe, a pressure sensor wire pipe, a pressure water pipe, a backup gas pipe, a power wire pipe, and at least one grouting tremie unit. The spiral conveyor includes a shaft-type spiral conveying belt and a negative-pressure device. A construction method for foundation reinforcement construction includes: cutting soil by the reamer head; crushing gravel by a gravel crusher; transporting, by the shaft-type spiral conveying belt, a soil-water mixture to a waste liquid tank; monitoring,
(Continued)

by the mass measuring device, a mass of the soil-water mixture discharged; and injecting equal-mass cement.

10 Claims, 4 Drawing Sheets

(51) Int. Cl.

| | |
|---|---|
| ***E21B 7/00*** | (2006.01) |
| ***E21B 10/26*** | (2006.01) |
| ***E21B 17/18*** | (2006.01) |
| ***E21B 47/06*** | (2012.01) |

(52) U.S. Cl.
CPC ..... *E21B 17/18* (2013.01); *E02D 2250/003* (2013.01); *E02D 2300/0023* (2013.01); *E21B 47/06* (2013.01)

(58) Field of Classification Search
CPC ..... E02D 2250/003; E02D 2300/0023; E21B 47/06; E21B 7/003; E21B 10/26; E21B 33/18; C04B 2111/00051; C04B 2111/00732; C04B 38/10; C04B 22/04; C04B 40/0032
See application file for complete search history.

(56) References Cited

U.S. PATENT DOCUMENTS

| | | | | |
|---|---|---|---|---|
| 2019/0145190 | A1* | 5/2019 | Li | C02F 1/686 405/128.45 |
| 2022/0120052 | A1* | 4/2022 | Zhang | E02D 5/80 |

FOREIGN PATENT DOCUMENTS

| | | | | |
|---|---|---|---|---|
| CN | 113073652 | A | 7/2021 | |
| CN | 115341849 | A | 11/2022 | |
| NL | 1032422 | C2 * | 10/2008 | E21B 7/003 |

* cited by examiner

AUGER-SUCTION TYPE METRO JET SYSTEM (MJS) DEVICE FOR AERATED AND LIGHTWEIGHT CEMENT SOIL AND CONSTRUCTION METHOD THEREOF

CROSS REFERENCE TO THE RELATED APPLICATIONS

This application is the continuation application of International Application No. PCT/CN2023/121179, filed on Sep. 25, 2023, the entire contents of which are incorporated herein by reference.

TECHNICAL FIELD

The present disclosure relates to the technical field of foundation reinforcement, and in particular to an auger-suction type metro jet system (MJS) device for aerated and lightweight cement soil and a construction method thereof.

BACKGROUND

With the depletion of shallow urban space for development, urban construction land is becoming increasingly scarce. To efficiently utilize the land resources in densely built urban areas, the development of underground spaces is rapidly advancing. In the process of underground space development, foundation reinforcement technology is often used to ensure the smooth implementation of underground construction around completed buildings and structures.

Three-axis mixing reinforcement is a commonly used method for foundation reinforcement. However, it is easy to generate certain lateral pressure on the soil around the reinforcement area. Furthermore, it is easy to generate vertical additional stress in the foundation due to the increased density of cement soil in the reinforcement area, which will cause foundation settlement, leading to pipeline rupture, road subsidence, and foundation displacement of surrounding buildings and structures.

Therefore, it is necessary to reduce and eliminate the harm of soil settlement and deformation caused by traditional foundation reinforcement methods, ensure the efficient and reliable construction of foundation reinforcement, and increase the applicable conditions of foundation reinforcement technology. In view of this, it is highly desirable to develop a self-drilling metro jet system (MJS) device for aerated cement soil.

SUMMARY

In order to overcome the above-mentioned deficiencies of the prior art, the present disclosure provides an auger-suction type metro jet system (MJS) device for aerated and lightweight cement soil and a construction method thereof.

The present disclosure resolves the technical problems with following technical solutions:

An aspect of the present disclosure provides an auger-suction type metro jet system (MJS) device for aerated and lightweight cement soil, including a multi-pipe device, a spiral conveyor, an outer sleeve, an integrated device, a reamer head, a pressure monitoring system, a mass measuring device, and a control console, where the pressure monitoring system includes a pressure sensor and a data acquisition device;

the multi-pipe device, the integrated device, and the reamer head are connected from top to bottom; and the outer sleeve is located outside the multi-pipe device to form a drill pipe body;

the multi-pipe device integrates a high-pressure cement slurry pipe, a backup pipe, a negative-pressure gas pipe, a hydraulic pipe, a negative-pressure water pipe, a main gas pipe, a pressure sensor wire pipe, a pressure water pipe, a backup gas pipe, and a power wire pipe;

a top of the outer sleeve is provided with a mud outlet, and the mud outlet is connected to a waste liquid tank;

the spiral conveyor includes a shaft-type spiral conveying belt and an electric device; the spiral conveyor is provided between the multi-pipe device and the outer sleeve; the spiral conveyor includes an inlet located at an end adjacent to the integrated device and an outlet communicated with the mud outlet; and the electric device is configured to drive the shaft-type spiral conveying belt;

an outer side of a cylindrical wall of the integrated device is provided with a high-pressure water nozzle, a pressure sensor, and a high-pressure grouting hole from top to bottom;

the reamer head is located at a bottom of the integrated device and communicated with a mud discharge channel inside the integrated device;

a motor device is provided in the integrated device and is configured to drive the reamer head to rotate separately for soil cutting, so as to avoid disturbance to surrounding soil caused by overall rotation and soil taking of a drill pipe;

a soil discharge channel is further provided in the integrated device; the soil discharge channel includes an inlet adjacent to the reamer head and an outlet connected to the inlet of the spiral conveyor; the inlet of the soil discharge channel is provided with a gravel crusher; and the outlet of the soil discharge channel is provided with a mud discharge pressure chamber valve for forcing cut soil to enter the spiral conveyor from the soil discharge channel and discharging a soil-water mixture formed after high-pressure water cutting and excess cement slurry after high-pressure grouting;

the main gas pipe is connected to the high-pressure grouting hole; and the negative-pressure gas pipe, the negative-pressure water pipe, and the backup gas pipe each form a pipeline provided with a pressure control valve in the integrated device and communicated with the soil discharge channel to assist in mud discharge and soil discharge;

the hydraulic pipe forms two branches in the integrated device, and the two branches are respectively provided with pressure control valves and communicated with the mud discharge pressure chamber valve and the motor device;

the pressure water pipe forms two branches in the integrated device, and the two branches are respectively provided with pressure control valves and communicated with the high-pressure water nozzle on the cylindrical wall of the integrated device and a pressure water outlet at a top of the reamer head;

the high-pressure cement slurry pipe includes an aerated cement slurry pipe and a lightweight cement slurry pipe and is communicated with the high-pressure grouting hole of the integrated device;

when the aerated cement slurry pipe is used, multiple branch gas pipes of the main gas pipe are communicated with the aerated cement slurry pipe to inject a gas into cement soil; and when the lightweight cement slurry pipe is used, lightweight cement slurry in a cement slurry silo is doped with a foaming agent;

the power wire pipe is configured to supply power; the high-pressure water nozzle is configured to spray high-pressure water for soil cutting; and the mud outlet is configured to discharge the soil-water mixture formed after high-pressure water cutting and the excess cement slurry after high-pressure grouting;

the pressure control valve is connected to the control console through a wire in the pressure sensor wire pipe and configured to adjust a gas pressure in the branch gas pipes based on water and soil pressure data to control the gas to enter cement slurry in the high-pressure cement slurry pipe;

the mass measuring device is provided in the waste liquid tank and configured to measure a mass of the soil-water mixture transported by a mud discharge pipe to the waste liquid tank and transmit measurement data to the control console; and the pressure sensor is connected to the data acquisition device through a wire in the pressure sensor wire pipe; the data acquisition device is connected to the control console; and the control console is configured to regulate each pressure control valve for collaborative control operation and control a motor.

Furthermore, an upper end of the aerated cement slurry pipe is connected to the cement slurry silo; the cement slurry is doped with a quick setting agent; the aerated cement slurry pipe is communicated with the main gas pipe through the branch gas pipes provided with pressure control valves in the integrated device; and after the aerated cement slurry pipe is communicated with the branch gas pipes for gas injection, the aerated cement slurry pipe penetrates into the main gas pipe from the high-pressure grouting hole to form a coaxial double-layer pipe structure that is communicated with the high-pressure grouting hole.

Furthermore, the pressure control valve is connected to the control console through the wire in the pressure sensor wire pipe and configured to adjust the gas pressure in the branch gas pipes based on the water and soil pressure data acquired by the pressure sensor so as to control the gas to enter the cement slurry in the high-pressure cement slurry pipe; a diameter of the branch gas pipes is determined by a gas flux injected into the high-pressure cement slurry pipe; and a diameter of the high-pressure cement slurry pipe in the coaxial double-layer pipe structure communicated with the high-pressure grouting hole is smaller than a diameter of the main gas pipe.

Furthermore, an upper end of the lightweight cement slurry pipe is connected to the cement slurry silo; and the lightweight cement slurry in the cement slurry silo is doped with the foaming agent, where the foaming agent includes a first type foaming agent and a second type foaming agent; the first type foaming agent is a surfactant foaming agent; and the second type foaming agent is a mixture of aluminum powder, iron powder, nekal, and an air entraining agent in a ratio of 9:9:1:1; the second type foaming agent is configured to generate closed bubbles in the cement slurry; the air entraining agent is configured to increase the bubbles and make the bubbles even; and the ratio of the second type foaming agent is adjustable according to indoor and on-site tests to adapt to more engineering scenarios.

Further, an amount of the foaming agent added to the cement slurry silo is adjustable in real time based on the water and soil pressure data acquired by the pressure sensor; and a volume of the lightweight cement soil is the same as a volume of the discharged soil-water mixture.

Furthermore, a gap is formed between the spiral conveyor and the multi-pipe device as well as the outer sleeve; the gap is determined by a gradation of discharged soil particles and configured to reduce a loss amount of cut soil and a problem of jamming caused by the cut soil; and an inclination angle of the spiral conveyor is determined by a friction force between the discharged cut soil and the conveying belt and configured to ensure that most of the soil particles and mud are transported out.

Furthermore, the backup gas pipe is configured to provide a pressure gas for unclogging a pipeline; an upper end of the main gas pipe is connected to an air compressor; and the branch pressure control valves of the negative-pressure gas pipe, the negative-pressure water pipe, the hydraulic pipe, the pressure water pipe, and the backup gas pipe, as well as the pressure sensor and the pressure control valve, are powered by a power wire in the power wire pipe, and are connected to the control console through a wire in the pressure sensor wire pipe.

Furthermore, the control console is configured to connect the multi-pipe device, the integrated device, the pressure monitoring system, and the mass measuring device and regulate drilling operation, high-pressure water cutting operation, high-pressure grouting reinforcement operation, and mud discharge operation of the auger-suction type MJS device for aerated and lightweight cement soil, as well as collaborative control operation of each pressure control valve; and the motor device is connected to branches of the hydraulic pipe and a power wire inside the power wire pipe, and a control wire of the motor device is connected to the control console through the pressure sensor wire pipe.

In another aspect, the present disclosure further provides a construction method, including the following steps:

carrying out positioning and layout, and setting up monitoring points of a groundwater level and a ground settlement in a target reinforcement area to monitor the groundwater level and the ground settlement in real time;

connecting a plurality of pipelines of the auger-suction type MJS device for aerated and lightweight cement soil; starting, by a control console, the auger-suction type MJS device for aerated and lightweight cement soil for drilling operation; driving, by a motor device, high-speed rotation of a reamer head, such that a reamer bit and a reamer blade on the reamer bit cut soil and a gravel crusher crushes gravel in a mixture to be discharged; forming a soil-water mixture from cut soil and pressure water sprayed from a pressure water outlet; discharging the soil-water mixture together with crushed gravel through a soil discharge channel, a mud discharge pressure chamber valve, and a spiral conveyor; and injecting, according to monitored data of a groundwater level change, pressure water to replenish groundwater so as to maintain the groundwater level unchanged;

closing, after the drilling operation reaches a design depth, the motor device, the pressure water outlet, and the mud discharge pressure chamber valve, and stopping the drilling operation;

starting, by the control console, a high-pressure water cutting and high-pressure cement slurry grouting reinforcement system of the auger-suction type MJS device for aerated and lightweight cement soil; spraying high-pressure water from a high-pressure water nozzle for soil cutting, and spraying high-pressure cement slurry from a high-pressure grouting hole for grouting reinforcement; and rotating and lifting a drill pipe at a certain speed while the high-pressure water nozzle and the high-pressure grouting hole continue to carry out high-pressure water cutting and high-pressure grouting reinforcement operations, respectively;

transmitting, by a pressure sensor, soil and water pressure data to the control console through a data acquisition device during high-pressure water cutting, such that the control console adjusts an opening/closing degree of the mud discharge pressure chamber valve to control the high-pressure cement slurry and high-pressure water provided, thereby maintaining constant soil and water pressure in the reinforcement area;

if there is a need to inject a gas into an aerated cement slurry pipe during high-pressure grouting: controlling, by the control console, a pressure control valve, such that a pressure gas in a branch gas pipe is injected into cement slurry in a high-pressure cement slurry pipe to form aerated cement slurry with evenly distributed bubbles; spraying the aerated cement slurry from the high-pressure grouting hole for grouting reinforcement; measuring, by a mass measuring device, a mass of the soil-water mixture and the gravel, and transmitting measurement data to the control console; and controlling, by the control console, a mass of the cement slurry injected into the reinforcement area, thereby ensuring equivalent gravity stress of a formation before and after construction in the reinforcement area;

closing, after the soil grouting reinforcement is completed, the auger-suction type MJS device for aerated and lightweight cement soil, and disconnecting the plurality of pipelines of the auger-suction type MJS device for aerated and lightweight cement soil; and repeating the above steps until all grouting reinforcement construction in the target reinforcement area is completed.

Further, the construction method includes the following steps: inspecting, during high-pressure grouting, the mass of the cement slurry according to a requirement of grouting reinforcement; and rotating and lifting, by a top power device, the drill pipe at a speed that satisfies requirements for pumping mud formed by a large amount of soil through the soil discharge channel and fully replacing original soil in the reinforcement area with injected aerated cement soil, thereby improving a soil strength in the reinforcement area while ensuring equivalent gravity stress of the formation before and after reinforcement construction.

Compared with the prior art, the present disclosure has the following beneficial effects:

1. In the present disclosure, the spiral conveyor is connected to a negative-pressure device, and the integrated device pumps the soil-water mixture and gravel to the shaft-type spiral conveying belt through the soil discharge channel. Based on physical friction, the soil-water mixture and gravel are mechanically transported to the waste liquid tank. Then, the soil particles and cement are directly pumped through a negative pressure, reducing resource consumption and embodying the concept of going green.
2. In the present disclosure, the spiral conveyor is separately provided with the electric device and operates separately from the multi-pipe device to avoid centrifugal splashing of mud on the shaft-type spiral conveying belt caused by the high speed of the multi-pipe device, thereby improving the efficiency of soil discharge.
3. In the present disclosure, there are two types of high-pressure cement slurry pipes. When an aerated cement slurry pipe is used, a gas is continuously added to the high-pressure cement slurry pipe through the branch gas pipe of the main gas pipe so as to quickly wrap the gas and form closed bubbles. The design ensures even gas distribution in the cement slurry and basically the same strength at different positions in the reinforcement area, avoiding the problem of fracture caused by uneven bubbles in some parts. The design effectively prevents ground settlement caused by the increased density of the reinforcement area after grouting, as well as potential hazards to surrounding buildings and structures. Therefore, the present disclosure fundamentally reduces and eliminates the soil settlement and deformation hazards caused by traditional foundation reinforcement methods, especially suitable for construction in densely built areas.

The aerated cement slurry pipe forms a coaxial double-layer pipe structure with the main gas pipe, wrapping the high-pressure gas around the high-pressure sprayed cement to regulate the range of cement spraying, making the foundation reinforced in a regular shape, thereby improving reliability and controllability.

When a lightweight cement slurry pipe is used, lightweight foam cement is used for reinforcement. The cement slurry and the foaming agent are fully and evenly mixed in a slurry silo, such that the foaming agent has sufficient time to foam in the cement slurry and form the lightweight foam cement slurry with stable and even bubbles, ensuring the stable mass of the lightweight foam cement slurry.

4. In the present disclosure, the reamer head is conical. The reamer blade on the reamer head is a serrated reamer blade for soil removal while cutting. The reamer head is separately connected to the electric device, which improves the efficiency of cutting and transporting soil, and saves time.
5. In the present disclosure, the soil discharge channel is configured to discharge the soil particles and mud during transportation, so as to prevent the collision and damage of cut soil to other pipelines in the integrated device and prevent a large amount of soil from accumulating in the integrated device and causing clogging.
6. In the present disclosure, the gravel crusher crushes the gravel in coarse-grained soil into powder to prevent the gravel discharged from the soil discharge channel from clogging the soil discharge channel. The crushed gravel can be pumped to the spiral conveyor under a low negative pressure. The present disclosure is suitable for construction in environments with gravel, reducing resource losses and protecting devices.
7. In the present disclosure, the mass measuring device is configured to achieve a balance between the amount of discharged soil and the mass of injected aerated cement, ensuring equivalent gravity stress of the formation before and after the construction in the reinforcement area and ensuring balance of soil and water pressure. Therefore, the present disclosure can avoid settlement caused by local density increase after reinforcement, reduce disturbance to the surrounding environment, and achieve safe and reliable construction.

Figure 1:
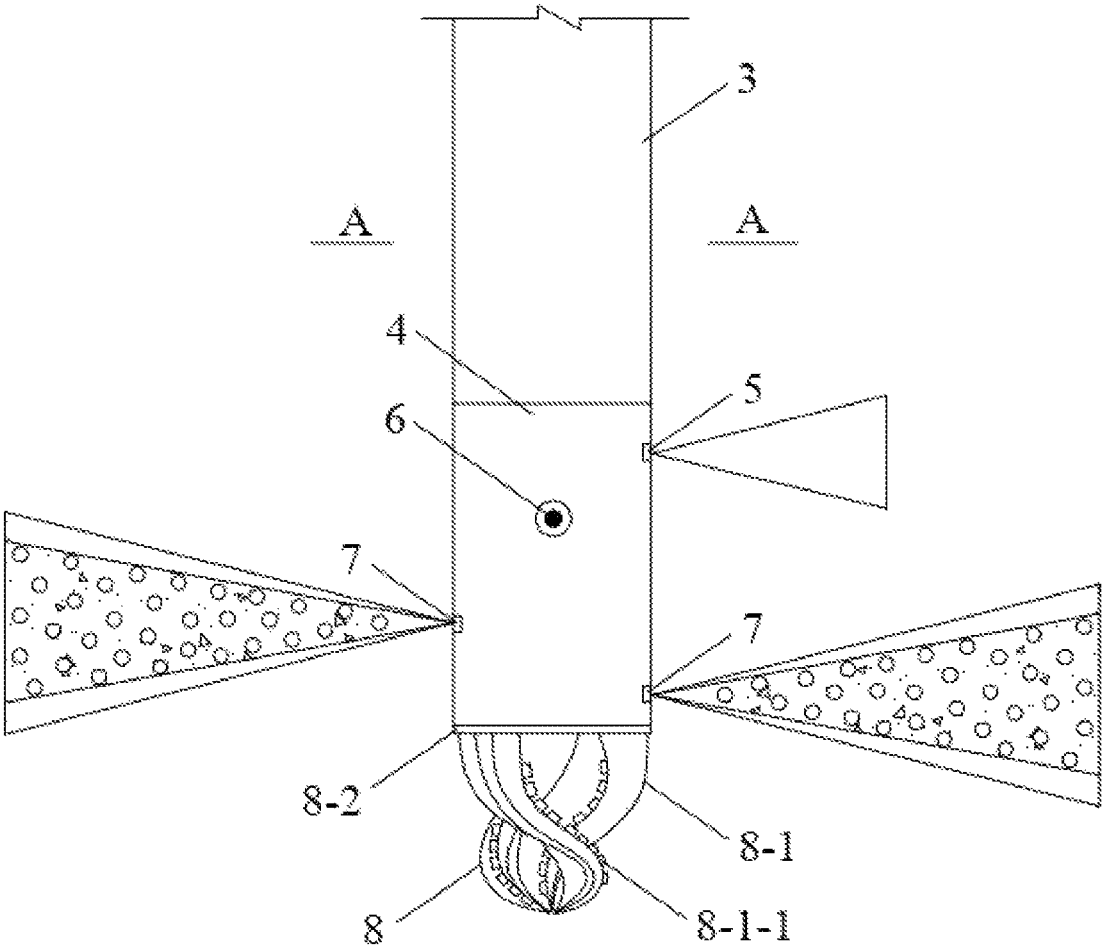
FIG. 1 is a lateral view of an auger-suction type metro jet system (MJS) device for aerated and lightweight cement soil according to the present disclosure.

Reference Numerals: 1, multi-pipe device; 1-1, high-pressure cement slurry pipe; 1-2, backup pipe; 1-3, negative-pressure gas pipe; 1-4, hydraulic pipe; 1-5, negative-pressure water pipe; 1-6, main gas pipe; 1-6-1, branch gas pipe; 1-7, pressure sensor wire pipe; 1-8, pressure water pipe; 1-9, backup gas pipe; 1-10, power wire pipe; 2, spiral conveyor; 3, outer sleeve; 4, integrated device; 5, high-pressure water nozzle; 6, pressure sensor; 7, high-pressure grouting hole; 8, reamer head; 8-1, reamer bit; 8-1, reamer blade; 8-2, reamer ring; 9, pressure control valve; and 10, mud outlet.

DETAILED DESCRIPTION OF THE EMBODIMENTS

The present disclosure is further described in detail below with reference to the drawings and embodiments.

Embodiment 1

As shown in FIG. 1, the embodiment of the present disclosure provides an auger-suction type metro jet system (MJS) device for aerated and lightweight cement soil, including multi-pipe device 1, spiral conveyor 2, outer sleeve 3, integrated device 4, reamer head 8, pressure monitoring system, a mass measuring device, and a control console. The pressure monitoring system includes pressure sensor 6 and a data acquisition device. The multi-pipe device, the integrated device, and the reamer head are connected from top to bottom. The outer sleeve is located outside the multi-pipe device to form a drill pipe body.

Figure 2:
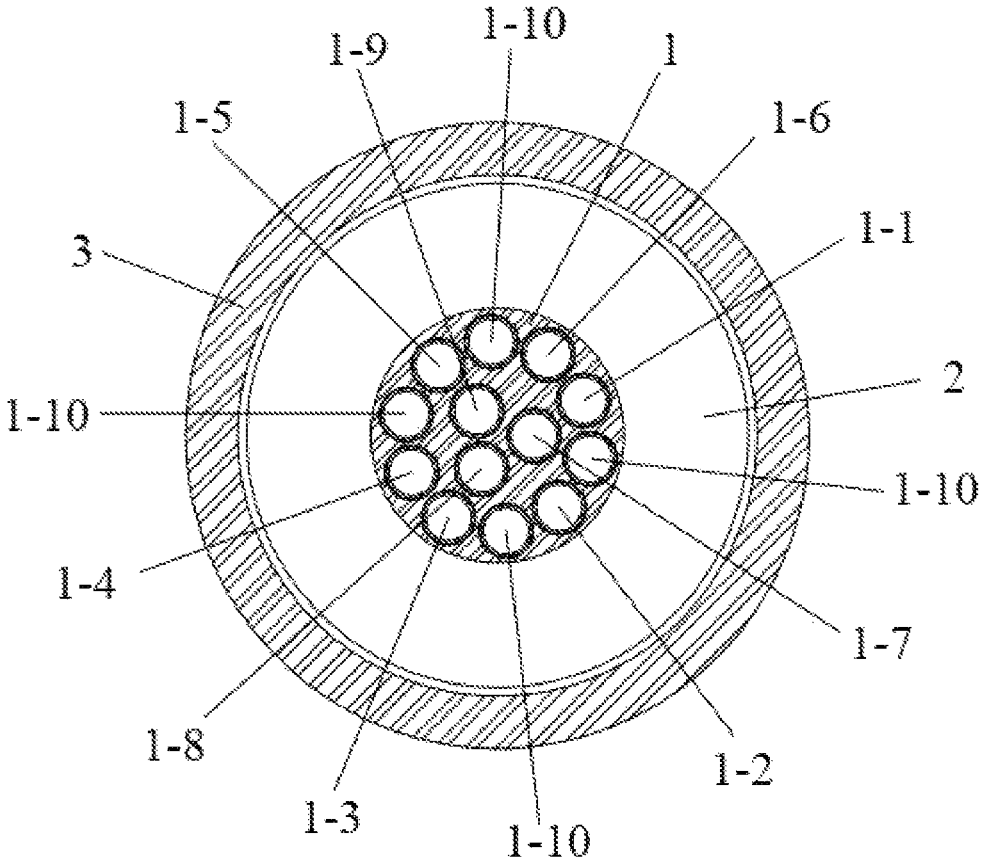
FIG. 2 is a sectional view along A-A shown in FIG. 1.

As shown in FIG. 2, the multi-pipe device 1 integrates high-pressure cement slurry pipe 1-1, backup pipe 1-2, negative-pressure gas pipe 1-3, hydraulic pipe 1-4, negative-pressure water pipe 1-5, main gas pipe 1-6, branch gas pipe 1-6-1, pressure sensor wire pipe 1-7, pressure water pipe 1-8, backup gas pipe 1-9, and power wire pipe 1-10.

A top of the outer sleeve 3 is provided with mud outlet 10, and the mud outlet 10 is connected to a waste liquid tank.

Figure 3:
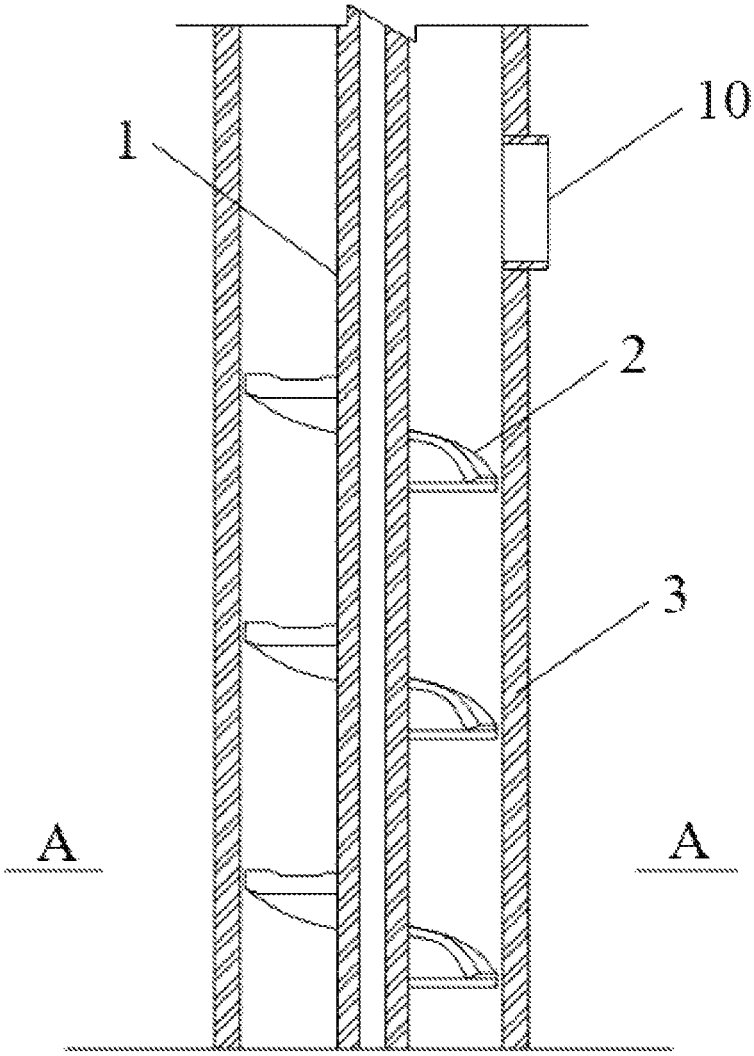
FIG. 3 is a sectional view of a spiral conveyor.

As shown in FIG. 3, the spiral conveyor 2 includes a shaft-type spiral conveying belt and an electric device. The spiral conveyor 2 is provided between the multi-pipe device 1 and the outer sleeve 3. The spiral conveyor 2 includes an inlet located adjacent to the integrated device 4 and an outlet communicated with the mud outlet 10. The electric device is provided at a near-top position inside the spiral conveyor 2, such that the shaft-type spiral conveying belt transports soil separately to avoid affecting rotary jet grouting reinforcement of the multi-pipe device 1.

An outer side of a cylindrical wall of the integrated device 4 is provided with high-pressure water nozzle 5, the pressure sensor 6, and high-pressure grouting holes 7 from top to bottom.

The reamer head 8 includes reamer bit 8-1 and reamer ring 8-2. The reamer bit 8-1 is fixedly connected to the reamer ring 8-2. Serrated reamer blade 8-1-1 is fixedly connected to the reamer bit 8-1. The reamer head 8 is located at a bottom of the integrated device 4 and is communicated by a mud discharge channel inside the integrated device 4.

A motor device is located at a near-bottom position inside the integrated device 4 and is configured to drive the reamer head 8 to rotate separately for soil cutting, so as to avoid disturbance to surrounding soil caused by overall rotation and soil taking of a drill pipe.

A soil discharge channel is further provided in the integrated device 4. The soil discharge channel includes an inlet adjacent to the reamer head 8 and an outlet connected to the spiral conveyor 2. The inlet of the soil discharge channel is provided with a gravel crusher for crushing gravel in cut soil particles. The outlet of the soil discharge channel is provided with a mud discharge pressure chamber valve for forcing cut soil to enter the spiral conveyor 2 from the soil discharge channel and discharging a soil-water mixture formed after high-pressure water cutting and excess cement slurry after high-pressure grouting.

The negative-pressure gas pipe 1-3, the negative-pressure water pipe 1-5, and the backup gas pipe 1-9 each form a pipeline with a pressure control valve in the integrated device 4, and the pipeline is communicated with the soil discharge channel to assist in mud discharge and soil discharge.

The hydraulic pipe 1-4 forms two branches in the integrated device 4, and the two branches are respectively provided with pressure control valves and communicated with the mud discharge pressure chamber valve and the motor device.

The pressure water pipe 1-8 forms two branches in the integrated device 4, and the two branches are respectively provided with pressure control valves and communicated with the high-pressure water nozzle 5 on the cylindrical wall of the integrated device 4 and a pressure water outlet at a top of the reamer head 8. The pressure water outlet at the top of the reamer head 8 is configured to spray pressure water for two purposes. First, during the soil cutting operation by the reamer head 8, drag reduction and cooling are carried out to facilitate the discharge of the soil-water mixture from the soil discharge channel. Second, the amount of groundwater discharged through the soil discharge channel is balanced to ensure that a groundwater level remains unchanged and prevent ground subsidence caused by groundwater recession.

The high-pressure grouting holes 7 are provided in pairs, and each of the high-pressure grouting holes 7 corresponds to a grouting tremie unit. The grouting tremie unit includes the high-pressure cement slurry pipe 1-1, the main gas pipe 1-6, the branch gas pipe 1-6-1, and pressure control valve 9. The branch gas pipe 1-6-1 is a branch formed by the main gas pipe 1-6 in the integrated device 4 and communicated with the high-pressure cement slurry pipe 1-1 through the pressure control valve 9. The pressure control valve 9 is configured to control a pressure of a gas injected into the high-pressure cement slurry pipe 1-1 from the branch gas pipe 1-6-1.

Figure 4:
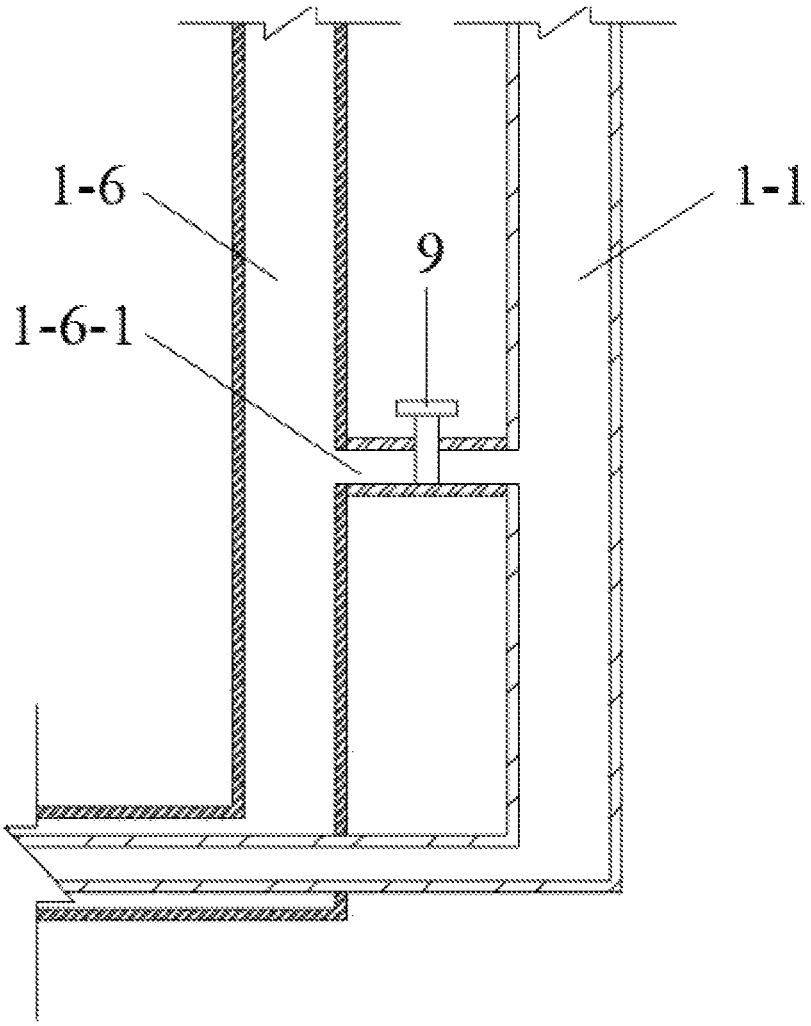
FIG. 4 is a schematic diagram of a grouting tremie unit.

As shown in FIG. 4, after the high-pressure cement slurry pipe 1-1 is communicated with the branch gas pipe 1-6-1 for gas injection, the high-pressure cement slurry pipe penetrates into the main gas pipe 1-6 from a position adjacent to the high-pressure grouting hole 7 to form a coaxial double-layer pipe structure that is communicated with the high-pressure grouting hole 7. The pressure control valve 9 is connected to the control console through a wire in the pressure sensor wire pipe 1-7, and is configured to adjust a gas pressure in the branch gas pipe 1-6-1 based on soil and water pressure data so as to control the gas to enter the cement slurry in the high-pressure cement slurry pipe 1-1, thereby ensuring even bubble distribution and a stable pore content in soil in a reinforcement area.

The pressure sensor 6 is connected to the data acquisition device through a wire in the pressure sensor wire pipe 1-7, and is configured to transmit real-time water and soil pressure data to the data acquisition device. The data acquisition device is connected to the control console. When the data acquisition device finds abnormal water and soil pressure, the control console adjusts an opening/closing degree of the mud discharge pressure chamber valve to control the high-pressure cement slurry and high-pressure water provided, thereby maintaining constant water and soil pressure in the reinforcement area.

The mass measuring device is provided in the waste liquid tank and configured to measure a mass of the soil-water mixture conveyed by the spiral conveyor 2 to the waste liquid tank and transmit measurement data to the control console, such that the control console controls a mass of the cement slurry poured into the reinforcement area, thereby ensuring equivalent gravity stress of a formation before and after the construction in the reinforcement area.

There is a certain distance between the spiral conveyor 2 and the multi-pipe device 1 as well as the outer sleeve 3. The distance ensures that there is no friction between the spiral conveyor 2 and the multi-pipe device 1 as well as the outer sleeve 3 during operation and reduces the loss amount of cut soil. An inclination angle of the spiral conveyor 2 ensures that most of the soil particles and mud are transported out.

Furthermore, multiple sections of the multi-pipe device 1 are connected by bolts. An upper end of the high-pressure cement slurry pipe 1-1 is connected to a cement slurry silo. The cement slurry in the high-pressure cement slurry pipe 1-1 is mixed with a quick setting agent, such that the gas injected by the branch gas pipe 1-6-1 is wrapped quickly to form closed bubbles. An upper end of the pressure water pipe 1-8 is connected to a pressure water tank. The backup gas pipe 1-9 is configured to provide a pressure gas for unclogging a pipeline. An upper end of the main gas pipe 1-6 is connected to an air compressor. The branch pressure control valves of the negative-pressure gas pipe 1-3, the negative-pressure water pipe 1-5, the hydraulic pipe 1-4, the pressure water pipe 1-8, and the backup gas pipe 1-9, as well as the pressure sensor 6, and the pressure control valve 9 are powered by a power wire in the power wire pipe 1-10, and are connected to the control console through a wire in the pressure sensor wire pipe 1-7.

The integrated device 4 is provided with at least one pair of high-pressure grouting holes 7. A diameter of the branch gas pipe 1-6-1 is determined by a gas flux injected into the high-pressure cement slurry pipe 1-1. A diameter of the high-pressure cement slurry pipe 1-1 in the coaxial double-layer pipe structure communicated with the high-pressure grouting hole 7 is smaller than a diameter of the main gas pipe 1-6.

Furthermore, the motor device is connected to branches of the hydraulic pipe 1-4 and the power wire inside the power wire pipe 1-10, and a control wire of the motor device is connected to the control console through the pressure sensor wire pipe 1-7.

Furthermore, the control console is configured to connect the multi-pipe device 1, the integrated device 4, the pressure monitoring system, and the mass measuring device and regulate drilling operation, high-pressure water cutting operation, high-pressure grouting reinforcement operation, and mud discharge operation of the auger-suction type MJS device for aerated and lightweight cement soil, as well as collaborative control operation of each pressure control valve.

Furthermore, a maximum diameter of the integrated device 4 is equal to a diameter of the outer sleeve 3, and a maximum outer diameter of the reamer head 8 is greater than an outer diameter of the outer sleeve 3 and the integrated device 4.

In another aspect, the embodiment of the present disclosure further provides a construction method using an aerated slurry pipe, including the following steps.

Step 1. Positioning and layout are carried out, and monitoring points of a groundwater level and a ground settlement are set up in a target reinforcement area to monitor the groundwater level and the ground settlement in real time.

Step 2. A plurality of pipelines of the auger-suction type MJS device for aerated and lightweight cement soil are connected. A drilling system of the auger-suction type MJS device for aerated and lightweight cement soil is started for drilling operation through a control console. A motor device drives high-speed rotation of reamer head 8, causing reamer bit 8-1 and reamer blade 8-1-1 on the reamer bit to cut soil and a gravel crusher crushes gravel in a mixture to be discharged. The soil after cutting and pressure water sprayed from a pressure water outlet form a soil-water mixture, which is discharged together with the crushed gravel through a soil discharge channel, a mud discharge pressure chamber valve, and spiral conveyor 2. According to monitored data of a groundwater level change, pressure water is injected to replenish groundwater so as to maintain the groundwater level unchanged.

Step 3. After the drilling operation reaches a design depth, the motor device, the pressure water outlet, and the mud discharge pressure chamber valve are closed, and the drilling operation is stopped.

Step 4. A high-pressure water cutting and high-pressure cement slurry grouting reinforcement system of the auger-suction type MJS device for aerated and lightweight cement soil is started through the control console. The high-pressure water is sprayed out from high-pressure water nozzle 5 for soil cutting, and high-pressure cement slurry is sprayed through high-pressure grouting hole 7 for grouting reinforcement. A drill pipe rotates and lifts at a certain speed, and the high-pressure water nozzle 5 and the high-pressure grouting hole 7 continue to carry out high-pressure water cutting and high-pressure grouting reinforcement operations, respectively.

During the process of high-pressure water cutting, pressure sensor 6 transmits soil and water pressure data to the control console through a data acquisition device, such that the control console adjusts an opening/closing degree of the mud discharge pressure chamber valve to control the high-pressure cement slurry and high-pressure water provided, thereby maintaining constant soil and water pressure in the reinforcement area.

During the high-pressure grouting process, the pressure control valve 9 is controlled through a control console, such that a pressure gas in the branch gas pipe 1-6-1 is injected into the cement slurry in the high-pressure cement slurry pipe 1-1 to form aerated cement slurry with evenly distributed bubbles. The aerated cement slurry is sprayed from the high-pressure grouting hole 7 for grouting reinforcement. The mass of the soil-water mixture and the gravel is measured by a mass measuring device, and measurement data is transmitted to the control console. The control console controls the mass of the cement slurry injected into the reinforcement area, thereby ensuring equivalent gravity stress of a formation before and after construction in the reinforcement area.

Step 5. After the soil grouting reinforcement is completed, the auger-suction type MJS device for aerated and lightweight cement soil is closed, and the plurality of pipelines of the auger-suction type MJS device for aerated and lightweight cement soil are disconnected.

Step 6. The above steps are repeated until all grouting reinforcement construction in the target reinforcement area is completed.

The mass of the cement slurry is inspected according to the requirements of grouting reinforcement. The drill pipe is rotated and lifted by a top power device at a speed that satisfies the requirements for pumping mud formed by a large amount of soil through the soil discharge channel and fully replacing original soil in the reinforcement area with injected aerated cement soil, thereby improving a soil strength in the reinforcement area while ensuring equivalent gravity stress of the formation before and after reinforcement construction.

In step 5, the pressure gas in the cement slurry injected into the high-pressure cement slurry pipe 1-1 through the branch gas pipe 1-6-1 is adjusted in real-time according to a grouting reinforcement depth, ensuring that even bubble distribution and stable pore content in the reinforced soil at different depths. The mass of the cement slurry injected into the reinforcement area is equal to the mass of natural soil discharged from the soil discharge channel. In step 6, the mass of the grouting reinforced soil is inspected by a standardized method.

Embodiment 2

An auger-suction type MJS device for lightweight cement soil reinforcement includes multi-pipe device 1, spiral conveyor 2, outer sleeve 3, integrated device 4, reamer head 8, pressure monitoring system, a mass measuring device, and a control console. The pressure monitoring system includes pressure sensor 6 and a data acquisition device.

The multi-pipe device 1 integrates high-pressure cement slurry pipe 1-1, backup pipe 1-2, negative-pressure gas pipe 1-3, hydraulic pipe 1-4, negative-pressure water pipe 1-5, main gas pipe 1-6, pressure sensor wire pipe 1-7, pressure water pipe 1-8, backup gas pipe 1-9, and power wire pipe 1-10.

The spiral conveyor 2 includes a shaft-type spiral conveying belt and an electric device. The spiral conveyor 2 is provided between the multi-pipe device 1 and the outer sleeve 3. The spiral conveyor 2 includes an inlet communicated with a mud discharge pressure valve and an outlet communicated with the mud outlet 10. An electric device is provided at a top position inside the spiral conveyor 2 and connected to the shaft-type spiral conveying belt to transport soil separately so as to avoid affecting rotary jet grouting reinforcement of the multi-pipe device 1.

The mud outlet 10 is provided at a top of the outer sleeve 3 and connected to an external waste liquid tank.

An outer side of a cylindrical wall of the integrated device 4 is provided with high-pressure water nozzle 5, the pressure sensor 6, and high-pressure grouting holes 7 from top to bottom.

The reamer head 8 includes reamer bit 8-1 and reamer ring 8-2. The reamer bit 8-1 is fixedly connected to the reamer ring 8-2. Serrated reamer blade 8-1-1 is fixedly connected to the reamer bit 8-1. The reamer head 8 is located at a bottom of the integrated device 4 and is communicated by a mud discharge channel inside the integrated device 4.

A motor device is located at a near-bottom position inside the integrated device 4. The motor device is connected to the reamer head 8 and drives the reamer head 8 to rotate separately for soil cutting, so as to avoid disturbance to surrounding soil caused by overall rotation and soil taking of a drill pipe.

A soil discharge channel is further provided in the integrated device 4. The soil discharge channel includes an inlet adjacent to the reamer head 8 and an outlet connected to the spiral conveyor 2. The inlet of the soil discharge channel is provided with a gravel crusher for crushing gravel in cut soil particles. The outlet of the soil discharge channel is provided with a mud discharge pressure chamber valve for controlling a speed at which cut soil enters the spiral conveyor 2 from the soil discharge channel.

The negative-pressure gas pipe 1-3, the negative-pressure water pipe 1-5, and the backup gas pipe 1-9 each are provided with a pressure control valve in the integrated device 4 and communicated with the soil discharge channel to assist in mud discharge and soil discharge.

The hydraulic pipe 1-4 forms two branches in the integrated device 4, and the two branches are respectively provided with pressure control valves and communicated with the mud discharge pressure chamber valve and the motor device.

The pressure water pipe 1-8 forms two branches in the integrated device 4, and the two branches are respectively provided with pressure control valves and communicated with the high-pressure water nozzle 5 on the cylindrical wall of the integrated device 4 and a pressure water outlet at a top of the reamer head 8. The pressure water outlet at the top of the reamer head 8 is configured to spray pressure water for two purposes. First, during the soil cutting operation by the reamer head 8, drag reduction and cooling are carried out. Second, the amount of groundwater discharged through the soil discharge channel is balanced to ensure that a groundwater level remains unchanged and prevent ground subsidence caused by groundwater recession.

The high-pressure water nozzle 5 is configured to spray high-pressure water for soil cutting. The soil discharge channel is configured to discharge a soil-water mixture formed after high-pressure water cutting and excess cement slurry after high-pressure grouting. The high-pressure grouting hole 7 is configured to spray high-pressure cement slurry for further cutting and reinforcement.

The pressure sensor 6 is connected to the data acquisition device through a wire in the pressure sensor wire pipe 1-7, and is configured to transmit real-time water and soil pressure data to the data acquisition device. The data acquisition device is connected to the control console. When the data acquisition device finds abnormal water and soil pressure, the control console adjusts an opening/closing degree of the mud discharge pressure chamber valve to control the high-pressure cement slurry and high-pressure water provided, thereby maintaining constant water and soil pressure in the reinforcement area.

The mass measuring device is provided in the waste liquid tank and configured to measure a mass of the soil-water mixture conveyed by the spiral conveyor 2 to the waste liquid tank and transmit measurement data to the control console, such that the control console controls a mass of the cement slurry poured into the reinforcement area, thereby ensuring equivalent gravity stress of a formation before and after the construction in the reinforcement area.

The spiral conveyor 2 is provided with an electric device to operate the shaft-type spiral conveying belt independently, avoiding the high-speed rotation of the multi-pipe device 1 during rotary jet grouting, which may cause centrifugal splashing of the crushed gravel or soil-water mixture on the shaft-type spiral conveying belt to damage the outer sleeve 3.

Multiple sections of the multi-pipe device 1 are connected by bolts. An upper end of the high-pressure cement slurry pipe 1-1 is connected to a cement slurry silo. The backup gas pipe 1-9 is configured to provide a pressure gas for unclogging a pipeline. An upper end of the pressure water pipe 1-8 is connected to a pressure water tank. An upper end of the main gas pipe 1-6 is connected to an air compressor. The branch pressure control valves of backup pipe 1-2, the negative-pressure gas pipe 1-3, the negative-pressure water pipe 1-5, the hydraulic pipe 1-4, the pressure water pipe 1-8, and the backup gas pipe 1-9, as well as the pressure sensor 6, are powered by a power wire in the power wire pipe 1-10, and are connected to the control console through a wire in the pressure sensor wire pipe 1-7.

A foaming agent is used, which includes a first type foaming agent and a second type foaming agent. The first type foaming agent is a surfactant foaming agent, and bubbles generated by the foaming agent meet the following requirements.

The bubbles are even and dense, with a density of 48 kg/m3 to 52 kg/m3.

A settling height of a standard bubble column within 1 h does not exceed 6 mm.

A bleeding volume of the standard bubble column within 1 h does not exceed 20 ml.

An increase rate of a wet density determined by a defoaming test does not exceed 10%. According to the Technical Specification for Foamed Mixture Lightweight Soil Filling Engineering, the surfactant foaming agent is directly supplied by a manufacturer; the second type foaming agent is a mixture of aluminum powder, iron powder, nekal, and a small amount of air entraining agent in a ratio of 9:9:1:1; the second type foaming agent is configured to generate closed bubbles in the cement slurry; the air entraining agent is configured to increase the bubbles and make the bubbles even; and the ratio of the second type foaming agent is adjustable according to indoor and on-site tests to adapt to more engineering scenarios.

An amount of the foaming agent added to the cement slurry silo is adjustable in real time based on the water and soil pressure data acquired by the pressure sensor 6. The volume of the lightweight cement soil is the same as the volume of the discharged soil-water mixture.

The control console is configured to connect the multi-pipe device 1, the integrated device 4, the pressure monitoring system, and the mass measuring device and regulate drilling operation, high-pressure water cutting operation, high-pressure grouting reinforcement operation, and mud discharge operation of the auger-suction type MJS device for lightweight cement soil reinforcement, as well as collaborative control operation of each pressure control valve.

A maximum diameter of the integrated device 4 is equal to a diameter of the outer sleeve 3, and a maximum outer diameter of the reamer head 8 is greater than an outer diameter of the outer sleeve 3 and the integrated device 4.

The motor device is connected to the branches of the hydraulic pipe 1-4 and the power wire inside the power wire pipe 1-10, and a control wire of the motor device is connected to the control console through the pressure sensor wire pipe 1-7.

In another aspect, the embodiment of the present disclosure further provides a construction method of the auger-suction type MJS device for lightweight cement soil reinforcement, including the following steps.

S1. Positioning and layout are carried out, and monitoring points of a groundwater level and a ground settlement are set up in a target reinforcement area to monitor the groundwater level and the ground settlement in real time.

S2. A plurality of pipelines of the auger-suction type MJS device for lightweight cement soil reinforcement are connected. A drilling system of the auger-suction type MJS device for lightweight cement soil reinforcement is started for drilling operation through a control console. A motor device drives high-speed rotation of reamer head 8, causing reamer bit 8-1 and reamer blade 8-1-1 on the reamer bit to cut soil and a gravel crusher crushes gravel in a mixture to be discharged. The soil after cutting and pressure water sprayed from a pressure water outlet form a soil-water mixture, which, together with the crushed gravel, enters the spiral conveyor 2 through a soil discharge channel and a mud discharge pressure chamber valve and is discharged to the waste liquid tank through the mud outlet 10. According to monitored data of a groundwater level change, pressure water is injected through the pressure water outlet to replenish groundwater so as to maintain the groundwater level unchanged.

S3. After the drilling operation reaches a design depth, the motor device, the pressure water outlet, and the mud discharge pressure chamber valve are closed, and the drilling operation is stopped.

S4. A high-pressure water cutting and high-pressure cement slurry grouting reinforcement system of the auger-suction type MJS device for lightweight cement soil reinforcement is started through the control console. The high-pressure water is sprayed out from high-pressure water nozzle 5 for soil cutting, and high-pressure cement slurry is sprayed through high-pressure grouting hole 7 for grouting reinforcement. A drill pipe rotates and lifts at a certain speed, and the high-pressure water nozzle 5 and the high-pressure grouting hole 7 continue to carry out high-pressure water cutting and high-pressure grouting reinforcement operations, respectively.

During the process of high-pressure water cutting, pressure sensor 6 transmits soil and water pressure data to the control console through a data acquisition device, such that the control console adjusts an opening/closing degree of the mud discharge pressure chamber valve to control the amount of high-pressure cement slurry and high-pressure water provided, thereby maintaining constant soil and water pressure in the reinforcement area.

S5. The mass of the soil-water mixture is measured by the mass measuring device, and measurement data is transmitted to the control console. The control console controls the mass of the lightweight foamed cement slurry injected into the reinforcement area, thereby ensuring equivalent gravity stress of a formation before and after construction in the reinforcement area.

S6. After the soil grouting reinforcement is completed, the auger-suction type MJS device for lightweight cement soil reinforcement is closed, and the plurality of pipelines of the auger-suction type MJS device for lightweight cement soil reinforcement are disconnected.

During the process of pulling the drill pipe, the pulling speed is controlled to ensure that the gravel is fully crushed by the gravel crusher in the soil discharge channel, thereby avoiding clogging of the spiral conveyor 2.

The mass of the cement slurry is inspected according to the requirements of grouting reinforcement. The speed at which the drill pipe is rotated and lifted by a top power device satisfies the requirements t mud formed by a large amount of soil through the soil discharge channel and ensuring that the injected lightweight foamed cement soil can fully replace the original soil in the reinforcement area, thereby improving a soil strength in the reinforcement area while ensuring equivalent gravity stress of the formation before and after reinforcement construction.

The technical principles of the present disclosure are described above with reference to the specific embodiments. These descriptions are merely intended to explain the principles of the present disclosure, and may not be construed as limiting the protection scope of the present disclosure in any way. Based on the explanation herein, those skilled in the art may derive other specific implementations of the present disclosure without creative effort, but these implementations should fall within the protection scope of the present disclosure.

What is claimed is:

1. An auger-suction type metro jet system (MJS) device for aerated and lightweight cement soil, comprising a multi-pipe device, a spiral conveyor, an outer sleeve, an integrated device, a reamer head, a pressure monitoring system, a mass measuring device, and a control console, wherein the pressure monitoring system comprises a pressure sensor and a data acquisition device;

the multi-pipe device, the integrated device, and the reamer head are connected from top to bottom; and the outer sleeve is located outside the multi-pipe device to form a drill pipe body;

the multi-pipe device integrates a high-pressure cement slurry pipe, a backup pipe, a negative-pressure gas pipe, a hydraulic pipe, a negative-pressure water pipe, a main gas pipe, a pressure sensor wire pipe, a pressure water pipe, a backup gas pipe, and a power wire pipe;

a top of the outer sleeve is provided with a mud outlet, and the mud outlet is connected to a waste liquid tank;

the spiral conveyor comprises a shaft-type spiral conveying belt and an electric device; the spiral conveyor is provided between the multi-pipe device and the outer sleeve; the spiral conveyor comprises an inlet located at an end adjacent to the integrated device and an outlet communicated with the mud outlet; and the electric device is configured to drive the shaft-type spiral conveying belt;

an outer side of a cylindrical wall of the integrated device is provided with a high-pressure water nozzle, a pressure sensor, and a high-pressure grouting hole from top to bottom;

the reamer head is located at a bottom of the integrated device and communicated with a mud discharge channel inside the integrated device;

a motor device is provided in the integrated device and is configured to drive the reamer head to rotate separately for soil cutting, so as to avoid disturbance to surrounding soil caused by overall rotation and soil taking of a drill pipe;

a soil discharge channel is further provided in the integrated device; the soil discharge channel comprises an inlet adjacent to the reamer head and an outlet connected to the inlet of the spiral conveyor; the inlet of the soil discharge channel is provided with a gravel crusher; and the outlet of the soil discharge channel is provided with a mud discharge pressure chamber valve for forcing cut soil to enter the spiral conveyor from the soil discharge channel and discharging a soil-water mixture formed after high-pressure water cutting and excess cement slurry after high-pressure grouting;

the main gas pipe is connected to the high-pressure grouting hole; and the negative-pressure gas pipe, the negative-pressure water pipe, and the backup gas pipe each form a pipeline provided with a pressure control valve in the integrated device and communicated with the soil discharge channel to assist in mud discharge and soil discharge;

the hydraulic pipe forms two branches in the integrated device, and the two branches are respectively provided with pressure control valves and communicated with the mud discharge pressure chamber valve and the motor device;

the pressure water pipe forms two branches in the integrated device, and the two branches are respectively provided with pressure control valves and communicated with the high-pressure water nozzle on the cylindrical wall of the integrated device and a pressure water outlet at a top of the reamer head;

the high-pressure cement slurry pipe comprises an aerated cement slurry pipe and a lightweight cement slurry pipe and is communicated with the high-pressure grouting hole of the integrated device;

when the aerated cement slurry pipe is used, multiple branch gas pipes of the main gas pipe are communicated with the aerated cement slurry pipe to inject a gas into cement soil; and when the lightweight cement slurry pipe is used, lightweight cement slurry in a cement slurry silo is doped with a foaming agent;

the power wire pipe is configured to supply power; the high-pressure water nozzle is configured to spray high-pressure water for soil cutting; and the mud outlet is configured to discharge the soil-water mixture formed after high-pressure water cutting and the excess cement slurry after high-pressure grouting;

a pressure control valve is connected to the control console through a wire in the pressure sensor wire pipe and configured to adjust a gas pressure in the branch gas pipes based on water and soil pressure data to control the gas to enter cement slurry in the high-pressure cement slurry pipe;

the mass measuring device is provided in the waste liquid tank and configured to measure a mass of the soil-water mixture transported by a mud discharge pipe to the waste liquid tank and transmit measurement data to the control console; and the pressure sensor is connected to the data acquisition device through a wire in the pressure sensor wire pipe; the data acquisition device is connected to the control console; and the control console is configured to regulate each pressure control valve for collaborative control operation and control a motor.

2. The auger-suction type MJS device for aerated and lightweight cement soil according to claim 1, wherein an upper end of the aerated cement slurry pipe is connected to the cement slurry silo; the cement slurry is doped with a quick setting agent; the aerated cement slurry pipe is communicated with the main gas pipe through the branch gas pipes provided with pressure control valves in the integrated device; and after the aerated cement slurry pipe is communicated with the branch gas pipes for gas injection, the aerated cement slurry pipe penetrates into the main gas pipe from the high-pressure grouting hole to form a coaxial double-layer pipe structure that is communicated with the high-pressure grouting hole.

3. The auger-suction type MJS device for aerated and lightweight cement soil according to claim 2, wherein the pressure control valve is connected to the control console through the wire in the pressure sensor wire pipe and configured to adjust the gas pressure in the branch gas pipes based on the water and soil pressure data acquired by the pressure sensor so as to control the gas to enter the cement slurry in the high-pressure cement slurry pipe; a diameter of the branch gas pipes is determined by a gas flux injected into the high-pressure cement slurry pipe; and a diameter of the high-pressure cement slurry pipe in the coaxial double-layer pipe structure communicated with the high-pressure grouting hole is smaller than a diameter of the main gas pipe.

4. The auger-suction type MJS device for aerated and lightweight cement soil according to claim 1, wherein an upper end of the lightweight cement slurry pipe is connected to the cement slurry silo;

and the lightweight cement slurry in the cement slurry silo is doped with the foaming agent, wherein the foaming agent comprises a first type foaming agent and a second type foaming agent;

the first type foaming agent is a surfactant foaming agent; and the second type foaming agent is a mixture of aluminum powder, iron powder, nekal, and an air entraining agent in a ratio of 9:9:1:1; the second type foaming agent is configured to generate closed bubbles in the cement slurry; the air entraining agent is configured to increase the bubbles and make the bubbles even; and the ratio of the second type foaming agent is adjustable according to indoor and on-site tests to adapt to more engineering scenarios.

5. The auger-suction type MJS device for aerated and lightweight cement soil according to claim 4, wherein an amount of the foaming agent added to the cement slurry silo is adjustable in real time based on the water and soil pressure data acquired by the pressure sensor; and a volume of the lightweight cement soil is same as a volume of the discharged soil-water mixture.

6. The auger-suction type MJS device for aerated and lightweight cement soil according to claim 1, wherein a gap is formed between the spiral conveyor and the multi-pipe device as well as the outer sleeve to ensure that the spiral conveyor is not in contact with the multi-pipe device and the outer sleeve during operation; the gap is determined by a gradation of discharged soil particles and configured to reduce a loss amount of cut soil and a problem of jamming caused by the cut soil; and an inclination angle of the spiral conveyor is determined by a friction force between the discharged cut soil and the conveying belt and configured to ensure that most of the soil particles and mud are transported out.

7. The auger-suction type MJS device for aerated and lightweight cement soil according to claim 1, wherein the backup gas pipe is configured to provide a pressure gas for unclogging a pipeline; an upper end of the main gas pipe is connected to an air compressor; and the branch pressure control valves of the negative-pressure gas pipe, the negative-pressure water pipe, the hydraulic pipe, the pressure water pipe, and the backup gas pipe, as well as the pressure sensor and the pressure control valve, are powered by a power wire in the power wire pipe, and are connected to the control console through a wire in the pressure sensor wire pipe.

8. The auger-suction type MJS device for aerated and lightweight cement soil according to claim 1, wherein the control console is configured to connect the multi-pipe device, the integrated device, the pressure monitoring system, and the mass measuring device and regulate drilling operation, high-pressure water cutting operation, high-pressure grouting reinforcement operation, and mud discharge operation of the auger-suction type MJS device for aerated and lightweight cement soil, as well as collaborative control operation of each pressure control valve; and the motor device is connected to branches of the hydraulic pipe and a power wire inside the power wire pipe, and a control wire of the motor device is connected to the control console through the pressure sensor wire pipe.

9. A construction method of an auger-suction type MJS device for aerated and lightweight cement soil, comprising the following steps:

carrying out positioning and layout, and setting up monitoring points of a groundwater level and a ground settlement in a target reinforcement area to monitor the groundwater level and the ground settlement in real time;

connecting a plurality of pipelines of the auger-suction type MJS device for aerated and lightweight cement soil; starting, by a control console, the auger-suction type MJS device for aerated and lightweight cement soil for drilling operation; driving, by a motor device, high-speed rotation of a reamer head, such that a reamer bit and a reamer blade on the reamer bit cut soil and a gravel crusher crushes gravel in a mixture to be discharged; forming a soil-water mixture from cut soil and pressure water sprayed from a pressure water outlet; discharging the soil-water mixture together with crushed gravel through a soil discharge channel, a mud discharge pressure chamber valve, and a spiral conveyor; and injecting, according to monitored data of a groundwater level change, pressure water to replenish groundwater so as to maintain the groundwater level unchanged;

closing, after the drilling operation reaches a design depth, the motor device, the pressure water outlet, and the mud discharge pressure chamber valve, and stopping the drilling operation;

starting, by the control console, a high-pressure water cutting and high-pressure cement slurry grouting reinforcement system of the auger-suction type MJS device for aerated and lightweight cement soil; spraying high-pressure water from a high-pressure water nozzle for soil cutting, and spraying high-pressure cement slurry from a high-pressure grouting hole for grouting reinforcement;

and rotating and lifting a drill pipe while the high-pressure water nozzle and the high-pressure grouting hole continue to carry out high-pressure water cutting and high-pressure grouting reinforcement operations, respectively;

transmitting, by a pressure sensor, soil and water pressure data to the control console through a data acquisition device during high-pressure water cutting, such that the control console adjusts an opening/closing degree of the mud discharge pressure chamber valve to control the high-pressure cement slurry and high-pressure water provided, thereby maintaining constant soil and water pressure in the reinforcement area;

if there is a need to inject a gas into an aerated cement slurry pipe during high-pressure grouting: controlling, by the control console, a pressure control valve, such that a pressure gas in a branch gas pipe is injected into cement slurry in a high-pressure cement slurry pipe to form aerated cement slurry with evenly distributed bubbles; spraying the aerated cement slurry from the high-pressure grouting hole for grouting reinforcement; measuring, by a mass measuring device, a mass of the soil-water mixture and the gravel, and transmitting measurement data to the control console; and controlling, by the control console, a mass of the cement slurry injected into the reinforcement area, thereby ensuring equivalent gravity stress of a formation before and after construction in the reinforcement area;

closing, after the soil grouting reinforcement is completed, the auger-suction type MJS device for aerated and lightweight cement soil, and disconnecting the plurality of pipelines of the auger-suction type MJS device for aerated and lightweight cement soil; and repeating the above steps until all grouting reinforcement construction in the target reinforcement area is completed.

10. The construction method according to claim 9, further comprising the following steps: inspecting, during high-pressure grouting, the mass of the cement slurry according to a requirement of grouting reinforcement; and rotating and lifting, by a top power device, the drill pipe at a speed that satisfies requirements for pumping mud formed by a large amount of soil through the soil discharge channel and fully replacing original soil in the reinforcement area with injected aerated cement soil, thereby improving a soil strength in the reinforcement area while ensuring equivalent gravity stress of the formation before and after reinforcement construction.

* * * * *